United States Patent [19]

Pearce

[11] 4,239,418

[45] Dec. 16, 1980

[54] ARCTIC MULTI-ANGLE CONICAL STRUCTURE HAVING A DISCONTINUOUS OUTER SURFACE

[75] Inventor: James C. Pearce, Claremont, Calif.

[73] Assignee: Chevron Research Company, San Francisco, Calif.

[21] Appl. No.: 34,046

[22] Filed: Apr. 27, 1979

Related U.S. Application Data

[63] Continuation-in-part of Ser. No. 891,422, Mar. 29, 1978, abandoned.

[51] Int. Cl.[3] ..... E02B 17/00

[52] U.S. Cl. ..... 405/211; 114/40; 405/217

[58] Field of Search ..... 405/61, 195, 211, 217, 405/224; 114/40, 41, 42

[56] References Cited

U.S. PATENT DOCUMENTS

| | | | |
|---|---|---|---|
| 3,754,403 | 8/1973 | Mott et al. | 405/196 |
| 3,766,874 | 10/1973 | Helm et al. | 114/264 |
| 3,831,385 | 8/1974 | Hudson et al. | 405/211 |
| 3,952,527 | 4/1976 | Vinieratos et al. | 405/217 |
| 3,972,199 | 8/1976 | Hudson et al. | 405/217 |
| 4,037,424 | 7/1977 | Anders | 405/224 X |
| 4,048,943 | 9/1977 | Gerwick | 405/211 X |
| 4,068,487 | 1/1978 | Pease et al. | 405/217 X |
| 4,102,144 | 7/1978 | Anders | 405/211 |

FOREIGN PATENT DOCUMENTS

| | | | |
|---|---|---|---|
| 433272 | 7/1974 | U.S.S.R. | 405/217 |

OTHER PUBLICATIONS

Oil and Gas Journal, Apr. 27, 1970, pp. 44–45.

"Monocone–A Mobile Gravity Platform for the Arctic Offshore", W. Jazrawi and J. Khanna, Fourth International Conference on Port and Ocean Engineering under Arctic Conditions, Sep. 1977.

*Primary Examiner*—David H. Corbin

*Attorney, Agent, or Firm*—J. A. Buchanan, Jr.; R. L. Freeland, Jr.

[57] ABSTRACT

An offshore structure which is able to withstand the ice forces imposed thereon by impinging ice sheets and other larger masses of ice wherein the structure has an upper conical portion coaxially positioned relative to a lower conical portion. The walls forming both the upper and lower portions are inclined at an angle to the horizontal to receive ice masses moving into contact with the structure. The angle of inclination from the horizontal of the upper portion is greater than the angle of inclination of the lower portion, and the cross-sectional diameter of the upper conical portion is less than that at the top of the lower conical portion so that there exists a step-like section between the upper conical portion and the lower conical portion.

29 Claims, 3 Drawing Figures

ARCTIC MULTI-ANGLE CONICAL STRUCTURE HAVING A DISCONTINUOUS OUTER SURFACE

CROSS-REFERENCE TO RELATED APPLICATION

This application is a continuation-in-part of U.S. application Ser. No. 891,422, filed Mar. 29, 1978, now abandoned.

This application is related to U.S. application Ser. No. 891,421, filed Mar. 29, 1978, by James C. Pearce, Paul M. Aagaard and Gordon E. Strickland.

FIELD OF THE INVENTION

The present invention relates to offshore structures for use in arctic and other ice-infested waters, and, more particularly, to an offshore structure which is able to withstand the forces imposed thereon by impinging ice sheets and other larger ice masses.

BACKGROUND OF THE INVENTION

In recent years, offshore exploration and production of petroleum products has been extended into arctic and other ice-infested waters in such locations as northern Alaska and Canada. These waters are generally covered with vast areas of sheet ice 9 months or more out of the year. Sheet ice may reach a thickness of 5 to 10 feet or more, and may have a compressive or crushing strength in the range of about 200 to 1000 pounds per square inch. Although appearing stationary, ice sheets actually move laterally with wind and water currents and thus can impose very high forces on any stationary structure in their paths.

A still more severe problem encountered in arctic waters is the presence of larger masses of ice such as pressure ridges, rafted ice or floebergs. Pressure ridges are formed when two separate sheets of ice move toward each other and collide, the overthrusting and crushing of the two interacting ice sheets causing the formation of a pressure ridge. Pressure ridges can be very large, with lengths of hundreds of feet, widths of more than a hundred feet and a thickness of up to 50 feet. Consequently, pressure ridges can exert a proportionally greater force on an offshore structure than ordinary sheet ice; thus, the possibility of pressure ridges causing extensive damage to an offshore structure or the catastrophic failure of a structure is very great.

A structure built strong enough to resist the crushing force exerted thereon by impinging ice, that is, strong enough to permit the ice to be crushed against the structure, enabling the ice to flow around it, would likely be very massive and correspondingly expensive to construct. Therefore, it has been proposed heretofore that structures which are to be used in ice-infested waters should be built with a sloping or ramp-like outer surface rather than with a surface which is vertically disposed to the impinging ice. As the ice comes into contact with the sloping outer surface, it is forced upwardly above its normal position which causes the ice to fail in flexure by placing a tensile stress in the ice. Since ice has a flexural strength of about 85 pounds per square inch, a correspondingly smaller force is imposed on the structure as the ice impinging thereon fails in flexure rather than compression.

Several forms of conical offshore structures having sloping outer surfaces are illustrated in a paper by J. V. Danys entitled "Effect of Cone-Shaped Structures on Impact Forces of Ice Floes", presented to the First International Conference on Port and Ocean Engineering under Arctic Conditions, held at the Technical University of Norway, Trondheim, Norway, during Aug. 13–30, 1971. Another paper of interest in this respect is that presented by Ben C. Gerwick, Jr., and Ronald R. Lloyd, entitled "Design and Construction Procedures for Proposed Arctic Offshore Structures", presented at the Offshore Technology Conference in Houston, Texas, April 1970.

As an ice sheet moves relative to and in contact with the sloping outer surface of a conical structure, it will be elevated along the sloping surface. The elevation of the ice sheet causes initial cracks to be formed in the sheet, which radiate outwardly from the point of contact. Circumferential cracks then form and cause the ice sheet to break up into wedge-shaped pieces. The approximate total force exerted on a conical structure then consists primarily of the force required to fail the impinging ice sheet in flexure, that is, the force required to form the initial radial or subsequent circumferential cracks, and the force caused by the broken ice pieces riding up on the outer surface of the structure and interacting therewith.

The force associated with the formation of initial and circumferential cracks in the ice sheet is primarily a function of the particular mechanical and geometrical properties of the ice impinging on the structure. The ride-up force is due to the broken ice pieces interacting with the structure and thus is dependent upon the surface area of the structure above the water line. Therefore, to reduce the total ice forces imposed on a conical structure, it is always desirable to keep the waterline diameter of the structure as small as possible.

Larger ice masses such as pressure ridges impacting a conically shaped structure will be lifted along the sloping outer surface of the structure to cause the ridges to fail in flexure. As with ice sheets, a radial crack will form in the ridge at the point of impact; the formation of a radial crack is followed by the formation of hinge cracks that occur at a relatively greater distance from the structure. As the ridge continues to move into the structure, it will break into large blocks of ice which fall away from the structure.

As indicated above, the force imposed on a structure by an impinging pressure ridge is much greater than that of an impinging ice sheet. The approximate total force exerted on a conical structure by a pressure ridge is a combination of the force required to fail the impinging ridge in flexure and the force caused by the broken ice pieces, formed by the failure of the ice sheet advancing ahead of the presure ridge, riding up on the outer surface of the structure and interacting therewith. The large blocks of ice formed when a pressure ridge fails in flexure tend not to ride up the outer surface of the structure; therefore, the ride-up force is essentially a result of pieces of sheet ice riding up the structure's outer surface.

Since structures located in waters in which larger ice masses are present are exposed to relatively greater ice forces, they must be built strong enough to withstand these greater ice forces. Utilizing present bottom-supported conical structure designs requires supporting the structure by means of additional foundation support, such as piling; however, this would increase the cost and time of installation of the structure. Without additional foundation support, the structure would have to be made larger and stronger to resist the greater ice forces, which would necessitate increasing its waterline diameter. This, however, would increase that component of the total ice force associated with the ride up of ice pieces on the structure, since the ride-up force is proportional to the surface area of the structure above the waterline. For a very large cone waterline diameter, this component of the force would be substantially greater than the force required to fail the impinging ice in flexure. Additionally, as these structures are designed for use in deeper waters, their overall size would likely increase.

Accordingly, present conical structures built strong enough to withstand the forces associated with larger ice masses would be correspondingly more expensive to construct and install than one merely designed to withstand the forces associated with an impinging ice sheet. In fact, such structures could be so massive as to be impractical and economically prohibitive to build. The present invention is directed to an offshore structure which is able to withstand the forces associated with large impinging ice masses, and at the same time is feasible from an economic and size standpoint.

SUMMARY OF THE INVENTION

Broadly speaking, the present invention comprises an offshore structure which is designed for operation in ice-infested waters and which is particularly suited for use in deeper waters, but not restricted to such use, in which sheet ice and other larger masses of ice, such as pressure ridges, are present. The offshore structure of this invention includes a lower portion in the shape of a truncated cone coaxially positionable on top of a base portion. An upper portion of the structure is in the shape of a second truncated cone and is coaxially positionable on top of said lower portion. The walls forming the upper and lower portions of the structure are inclined at an angle to the horizontal to receive ice masses moving relative to and in contact with the structure in order to cause the ice masses to fail in flexure. The angle of inclination from the horizontal of the walls of the upper portion is greater than that of the lower portion, and the cross-sectional diameter of the upper portion is less than that at the top of the lower portion so that there exists a step-like section or discontinuity between the walls of the upper and lower conical portions.

The angle of inclination of the walls of the upper portion is between approximately 26° and 70° from the horizontal, with the preferred range being between approximately 54° and 58° from the horizontal. The angle of inclination of the walls of the lower portion is between approximately 15° and 25° from the horizontal, with the preferred range being between approximately 19° and 23° from the horizontal.

The above offshore structure configuration permits the structure to be utilized in relatively deeper waters which contain ice sheets and relatively larger ice masses without unnecessarily increasing the mass and the cost of a structure.

PRINCIPAL OBJECT OF THE INVENTION

The particular object of the present invention is to provide an offshore structure which is able to withstand the forces imposed thereon by impinging ice sheets and larger ice masses and which incorporates less structural material wherein the structure has an upper conical portion coaxially positioned relative to a lower conical portion so that the walls forming both the upper and lower portions are inclined at an angle to the horizontal to receive ice masses moving into contact with the structure, the angle of inclination from the horizontal of the upper portion being greater than that of the lower portion and the cross-sectional diameter of the upper portion being less than that at the top of the lower portion so that there exists a step-like section between the upper and lower portions.

Additional objects and advantages of the invention will become apparent from a detailed reading of the specification and drawings which are incorporated herein and made a part of this specification.

DESCRIPTION OF THE PREFERRED EMBODIMENT

Figure 1:
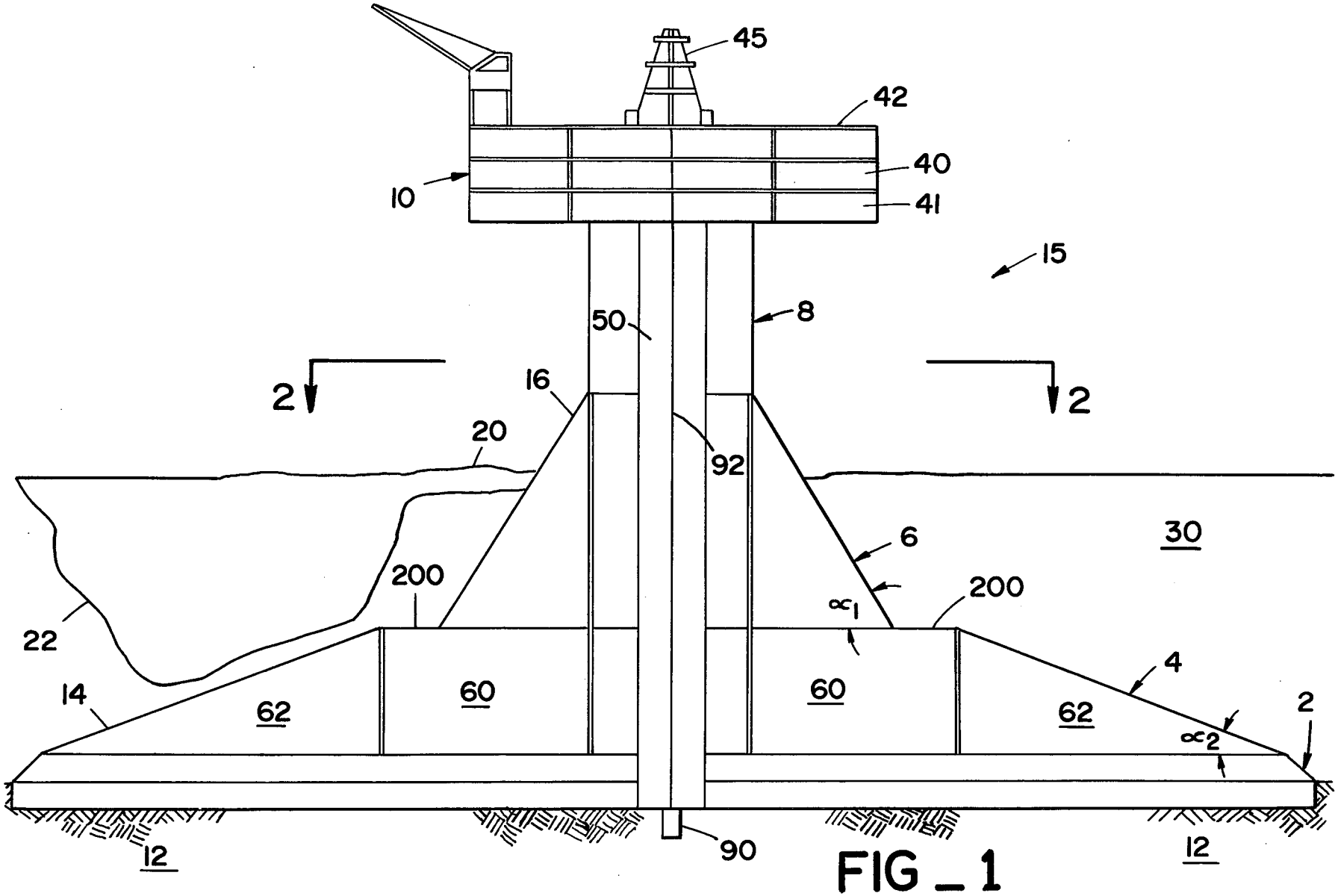
FIG. 1 is a schematic side elevation view, partly in section, illustrating the preferred embodiment of the invention.

Referring now to the drawings, FIG. 1 represents a marine structure 15 located in a body of water 30 and particularly designed for installation in arctic waters upon which thick sheets of ice 20 and larger masses of ice such as pressure ridges 22 may be formed. The structure is held in place on the underwater bottom 12 by its own weight plus the weight of any ballast, as will be discussed in more detail below, added to the structure.

A work platform 10 of structure 15 is illustrated in FIG. 1 with a drilling rig 45 located on its deck 42; other conventional drilling equipment, which is not illsutrated, may also be located on work platform 10. The invention, however, is not restricted to offshore structures used to support drilling rigs. It is suitable for any type of offshore operation conducted in arctic waters in which there is a need for protection against ice masses formed on such waters.

The work platform 10 may actually contain several additional levels of decks 40 and 41 which serve as living quarters and working areas for the personnel on the structure. The decks may be enclosed and heated to provide a reasonably comfortable working environment which offers protection for men and equipment during winter weather, during which temperatures may drop to the range of −60° F. The interior of the structure may also contain storage and equipment comparments which are illustrated generally by reference numeral 60.

Offshore structure 15 is constructed to be readily established with full operating capacity at a selected drilling site and with the ability to be moved from one drilling site and established at another in operating condition without delay. To this purpose, ballast tanks 62 are integrally built into the interior of the structure to provide appropriate stability when the structure is being towed and to enable the structure to be lowered through the water and into contact with the sea bottom. The ballast tanks may, of course, be trimmed as necessary to compensate for any uneven distribution of weight within the structure. The ballast tanks are each provided with appropriate means, such as sea cocks and a blowdown pipe, neither of which is illustrated, for remotely controlling the amount of water in the tanks so that the buoyancy of the structure is adjustable.

As indicated above, a drill rig 45 is located on decks 42 along with other conventional drilling equipment, not shown, for use in drilling as well bore 90 within the subsurfaces. A moon-pool or drillway 50 thus extends from deck 42 down through the structure to water bottom 12 so that drill string 92 may be extended into wellbore 90. Since it is both expensive and difficult to construct and install a structure in arctic waters, it is desirable that the structure be provided with the capability to drill a number of wells at any particular site. For example, a structure may be designed to drill two or more wells to a depth of approximately 20,000 feet. Accordingly, the structure must be made large enough to accommodate the equipment necessary for this purpose.

An offshore structure large enough to carry out the above-described drilling activities will weigh several thousand tons before it receives any of the equipment necessary for the drilling operation. Moreover, the weight of existing designs for bottom-supported structures increases proportionately as the structure is designed to withstand greater natural ice forces such as those associated with larger ice masses such as pressure ridges. Since the weight of the structure is directly related to its costs, the cost will proportionately increase as the weight increases. The present invention is directed toward an offshore structure configuration which is particularly adaptable for use in deeper waters, but which is not restricted to use in deeper waters, and which minimizes the forces imposed on the structure by impinging ice sheets and larger masses of ice, and, at the same time, permits less structural material to be incorporated in the structure and correspondingly reduces its mass and cost.

As discussed hereinabove, an ice sheet that moves into contact with the sloping surface of a conically shaped offshore structure will fail in flexure resulting in the ice sheet being broken into wedge-shaped segments. As the ice sheet continues to move against the structure, the wedge-shaped pieces of ice will ride up the outer surfaces of the structure and ideally fall away from and be swept around the structure. As the ice masses impinging on the structure become larger, the forces imposed thereon are likewise increased. To prevent failure of the present designs for bottom-supported conical structures, when a larger mass of ice such as a pressure ridge moves into contact with the structure, several things may possibly be done. First, the base diameter of the structure and thus its size may be increased to resist the larger ice forces. Second, the structure may be provided with a rather gently sloping surface, which also increases its size, to receive the impinging pressure ridge; this has the effect of reducing the total ice force imposed on the structure by the impinging ridge, since that component of total force due to flexural failure of a ridge decreases as the angle of inclination from the horizontal of the sloping surface decreases. Third, the structure may be supported by piling; however, this is undesirable because the cost and time of installation for the structure at a selected drilling site would be increased.

To resist the greater forces associated with larger impinging ice masses, the size of present designs for bottom-supported conical structures would then have to be increased, which necessitates incorporating more structural material in the structure which increases its mass and thus its cost, making it prohibitively expensive to build. Moreover, the size of the structure also tends to increase as the structure is designed for use in deeper waters. As these structures are built larger, the total ice force imposed on the structure increases. As pointed out previously, the total ice force exerted on a conical offshore structure essentially consists of the force required to fail the impinging ice mass in flexure and the force caused by broken pieces of sheet ice riding up the outer surface of the structure and interacting therewith. This ride-up force depends upon the weight of the ice pieces as well as the force of friction existing between the ice and the outer surfaces of the structure. Thus, it can be seen that ride-up ice force is proportional to the surface area of the conical structure above the waterline. Therefore, as the size of the structure is increased, the ride-up force imposed on the structure is likewise increased, and for conical structures having relatively large waterline diameters, the ride-up force may well exceed the force required to fail the impinging ice mass in flexure.

Figure 3:
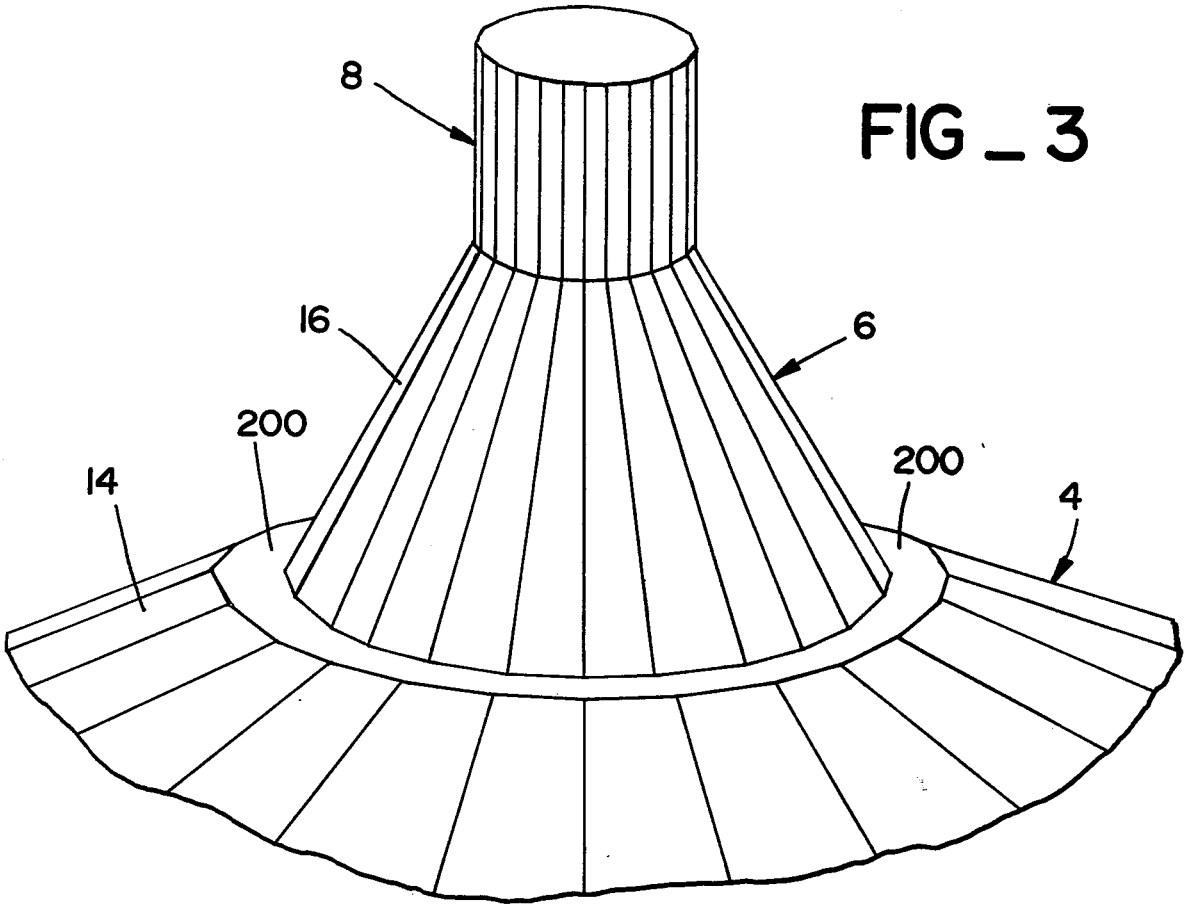
FIG. 3 is a partial perspective view showing the upper and lower conical portions and the throat portion as being fabricated from steel plate.
Figure 2:
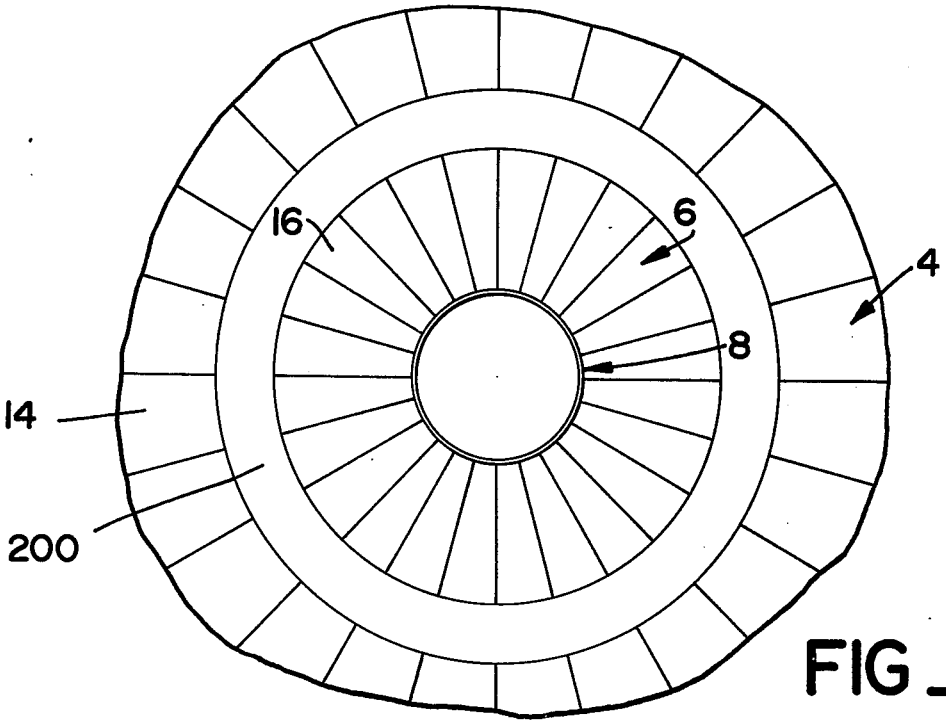
FIG. 2 is a plan view of FIG. 3.

Accordingly, there is provided in accordance with the present invention an offshore structure which is able to withstand the forces imposed thereon by an impinging ice sheet 20 or some other larger mass of ice such as a pressure ridge 22 wherein the mass and cost of the structure is not unnecessarily increased. This structure basically has, as illustrated in FIGS. 1–3, a lower conically shaped portion 4 and upper conically shaped portion 6 coaxially positioned with respect to one another to form a continuous external shell which has a discontinuity 200 therein and which is adapted to receive ice masses moving relative to and in contact with the structure. It is contemplated that the external shell of the structure is to be constructed from steel plate, as illustrated in FIG. 3, but other materials, such as prestressed concrete, may be used.

The upper portion 6, as can be seen, is in the shape of a truncated cone wherein the walls form a ramp-like surface 16 which is inclined at an angle to the horizontal so that surface 16 converges upwardly and inwardly of lower portion 4. The lower portion 4 of the structure likewise is in the shape of a truncated cone, but is of larger cross-sectional diameter than upper portion 6; that is, the base diameter of the cone forming upper portion 6 is less than the top diameter of the cone-forming lower portion 4 so that there exists a step-like section 200 between the walls of the upper portion 6 and the walls of the lower portion 4. The walls of lower portion 4 converge upwardly and inwardly of base portion 2 to form a ramp-like surface 14 which is inclined at an angle to the horizontal, but at an angle of inclination from the horizontal which is less than that of upper portion 6.

Thus, the waterline diameter of upper section 6 is kept as small as practicable to reduce the ride-up forces acting on the structure. On the other hand, to enable the structure to withstand the forces associated with larger impinging ice masses, a relatively large lower section 4 with a reduced angle of inclination is provided. The reduced angle of inclination of lower section 4 offers the advantage of reducing the forces imposed on the structure by the flexural failure of a pressure ridge. Additionally, the relatively large lower section 4 decreases the likelihood of foundation failure of the structure, as well as improving its flotation stability. Moreover, the discontinuity or step-like section 200 existing between section 4 and section 6 reduces the overall mass of the structure and thus its cost, making it feasible for use in deeper waters.

The base portion 2 of the structure may also have a conical shape so that its walls converge upwardly and inwardly of the underwater bottom 12, with the top diameter of the base portion being approximately equal to the bottom diameter of lower portion 4. This particular shape is useful from the point of view that it imparts additional stability to the structure when it is being moved through the water. In addition, the ramp-like surface of base portion 2 may assist in failing an impinging pressure ridge. Of course, base portion 2 may have other appropriate shapes, such as that of a cylinder, so that walls of the base portion are vertically disposed to the underwater bottom.

In deeper waters, larger ice masses, such as pressure ridge 22, extend a considerable distance below the surface of the water; therefore, when they move relative to and in contact with structure 15, the edge portion of the ridge 22 will be received by wall of the lower portion 4 and lifted along surface 14, causing the ridge to fail in flexure. As the pressure ridge is elevated along surface 14, it breaks into blocks of ice which tend to slide beneath the ice sheet advancing behind the ridge; the blocks of ice are then swept laterally around the structure. Surface 16 of upper portion 6 will receive the ice sheets impinging on the structure, and, as described, cause them to fail in flexure.

If the structure were located in relatively shallow waters, the lower conical portion 4 would receive and fail in flexure ice sheets and smaller pressure ridges impinging on the structure. The only force imposed on the upper portion 6 would be that associated with the ride up of pieces of sheet ice on surface 16.

To assist the movement of ice relative to and over the outer surfaces of the upper portion 6 and lower portion 4 of the structure and to prevent ride-up ice pieces from freezing to these surfaces, appropriate adfreeze prevention apparatus should be used. Adfreeze prevention procedures include heating the outer surfaces 14 and 16 of the structure, as disclosed in Chevron Research Company's U.S. Pat. No. 3,831,385, or coating the surfaces with a material that reduces ice adhesion, as disclosed in Chevron Research Company's U.S. Pat. No. 3,972,199.

The angle of inclination of the walls of the lower portion 4 and the upper portion 6 of the structure are indicated by $\alpha_1$ and $\alpha_2$, respectively. These two angles are acute angles which should be steep enough to cause failure of an ice mass in flexure. The value of $\alpha_1$ needs to be small enough so that the force associated with the flexural failing of a large ice mass is minimized. However, the value of $\alpha_1$ should not be too small, as the base of the structure would then be too large, making the cost of the structure economically prohibitive. The value of $\alpha_2$ is large enough such that the surface area of the structure above the waterline is minimized, but not so large as to cause an impinging ice sheet to fail in compression rather than flexure. In most multi-angle conical structures, $\alpha_1$ and $\alpha_2$ may range between approximately 15° and 25° and 26° to 70° from horizontal, respectively. The preferred range of $\alpha_1$ is between approximately 19° to 23° from the horizontal, and the preferred range of $\alpha_2$ is between approximately 54° and 58°. The preferred angle for $\alpha_1$, and $\alpha_2$, respectively, is essentially dependent upon three factors, namely, the range of water depths in which the structure is to be located, the expected size of ice sheets and pressure ridges in these waters, and the soil characteristics of the sea floor on which the structure is to be supported. Therefore, if a structure having a step-like section is to be operated in the relatively deeper waters off northern Alaska, the preferred angle for $\alpha_1$ is approximately 21° from the horizontal and the preferred angle for $\alpha_2$ is approximately 56° from the horizontal.

As illustrated in FIG. 1, the throat portion 8 of the structure, which has a cylindrical shape, is coaxially positioned on top of and vertically abuts upper portion 6 and extends work platform 10 above the surface of the body of water 30 to a height sufficient to avoid contact with pieces of sheet ice riding up the structure.

While it is contemplated that structure 15 will be towed to the drilling site in a completely assembled condition with no additional construction at the site being necessary, it would certainly be possible and perhaps desirable to tow individual sections of the structure from their place of fabrication to the drilling site for assembly. For example, base portion 2 could be brought to the drilling site and placed on the underwater bottom 12. Lower portion 4 could then be brought to the drilling site and positioned in abutting relationship on top of and joined by appropriate means to base portion 2. Likewise, upper portion 6 would be brought to the drilling site and positioned on top of lower portion 4 and joined to lower portion 4. In a like manner, the other components of the structure could be assembled at the drilling site.

The advantages of this disclosure can be realized by variations in the configuration of the structure in that the circumferential walls of the upper and lower portions of the structure need not have any one particular geometric shape, but may be of any shape that provides the outer surface of the structure in the area of potential contact with impinging ice masses with a sloping surface for receiving and supporting the impinging ice so as to elevate the ice above its natural level to cause it to fracture. For example, the circumferential walls of the upper and lower portions of the structure may have a multi-cone geometry of more than two conical sections or be in the shape of a portion of hyperboloid of revolution or have a generally truncated pyramidal configuration. Further, taking into account construction costs and problems, the circumferential walls of upper portion 6 and lower portion 4, as illustrated in FIGS. 2 and 3, may actually be comprised of a plurality of generally wedge-shaped segments arranged to provide a ramp-like outer surface for receiving impinging ice masses. Specifically, as illustrated, the peripheral or circumferential walls of the upper and lower portions of the structure may be constructed of 24 individual segments of flat plate with a fewer or greater number used as deemed desirable. Further, the dimensions of each plate need not be identical in achieving the result contemplated by the present invention.

Although certain specific embodiments of the invention have been described herein in detail, the invention is not to be limited to only such embodiments, but rather only by the appended claims.

What is claimed is:

1. An offshore structure for use in a body of water that contains ice masses, comprising a lower portion having a first circumferential wall substantially in the shape of a first truncated cone so that the wall of said lower portion is inclined at an angle to the horizontal, said first circumferential wall providing a ramp-like surface means for receiving ice masses moving relative to and in contact with said structure so as to elevate said ice above its natural level to cause said ice to fail in flexure adjacent said structure;

means for affixing said lower portion to the bottom of a body of water; and an upper portion coaxially positionable above said lower portion, said upper portion having a second circumferential wall substantially in the shape of a second truncated cone so that the wall of said upper portion is inclined at an angle to the horizontal, said second circumferential wall providing a ramp-like surface means for receiving ice masses moving relative to and in contact with said structure so as to elevate said ice above its natural level to cause said ice to fail in flexure adjacent said structure, the angle of inclination from the horizontal of the wall of said upper portion being greater than the angle of inclination from the horizontal of the wall of said lower portion and the cross-sectional diameter of the wall of said upper portion being less than the cross-sectional diameter at the top of the wall of said lower portion so that there exists a step-like section between the wall of said upper portion and the wall of said lower portion.

2. A marine structure for use in a body of water that contains ice masses, comprising a base portion;

means for affixing said base portion to the bottom of a body of water;

a lower portion coaxially positionable on top of said base portion for joining thereto, said lower portion forming a first circumferential wall substantially in the shape of a first truncated cone so that the wall of said lower portion is inclined at an angle to the horizontal, said first circumferential wall providing a ramp-like surface means for receiving ice masses moving relative to and in contact with said structure so as to elevate said ice above its natural level to cause said ice to fail in flexure adjacent said structure; and an upper portion coaxially positionable on top of said lower portion for joining thereto, said upper portion forming a second circumferential wall substantially in the shape of a second truncated cone so that the wall of said upper portion is inclined at an angle to the horizontal, said second circumferential wall providing a ramp-like surface means for receiving ice masses moving relative to and in contact with said structure so as to elevate said ice above its natural level to cause said ice to fail in flexure adjacent said structure, the angle of inclination from the horizontal of the wall of said upper portion being greater than the angle of inclination of the wall of said lower portion and the cross-sectional diameter of the wall of said upper portion being less than the cross-sectional diameter at the top of the wall of said lower portion so that there exists a step-like section between the wall of said upper portion and the wall of said lower portion.

3. The marine structure of claim 2 wherein the angle of inclination of the wall of said lower portion is between about 15° and 25° from the horizontal and wherein the angle of inclination of the wall of said upper portion is between about 26° and 70° from the horizontal.

4. The marine structure of claim 2 wherein the angle of inclination of the wall of said lower portion is between about 19° and 23° from the horizontal and wherein the angle of inclination of the wall of said upper portion is between about 54° and 58° from the horizontal.

5. The marine structure of claim 2 wherein the angle of inclination of the wall of said lower portion is about 21° from the horizontal and wherein the angle of inclination of the wall of said upper portion is about 56° from the horizontal.

6. The marine structure of claim 2 wherein said base portion is affixed to the bottom of said body of water.

7. The marine structure of claim 2 further including:

a cylindrical throat portion coaxially positionable on top of said upper portion for joining thereto and for extending a work platform above the surface of said body of water.

8. The marine structure of claim 7 wherein the angle of inclination of the wall of said lower portion is between about 15° and 25° from the horizontal and the angle of inclination of the wall of said upper portion is between about 26° and 70° from the horizontal.

9. The marine structure of claim 7 wherein the angle of inclination of the wall of said lower portion is between about 19° and 23° from the horizontal and the angle of inclination of the wall of said upper portion is between about 54° and 58° from the horizontal.

10. The marine structure of claim 7 wherein the angle of inclination of the wall of said lower portion is about 21° from the horizontal and the angle of inclination of the wall of said upper portion is about 56° from the horizontal.

11. The marine structure of claim 7 wherein said base portion is affixed to the bottom of said body of water.

12. An offshore structure for use in a body of water which becomes frozen through natural conditions, comprising:

a supporting base portion positioned in a body of water;

a means for securing said base portiin to the underwater bottom;

a lower portion directly joined to and rigidly supported on said base portion, said lower portion forming a first peripheral wall which converges upwardly and inwardly of said base portion, said first peripheral wall providing means for receiving and supporting an edge portion of a sheet of ice or other larger mass of ice which moves in contact with said lower portion so as to elevate said ice above its natural level an amount to cause said ice to fracture continuously adjacent said offshore structure; and an upper portion directly joined to and rigidly supported on said lower portion, said upper portion forming a second peripheral wall which converges upwardly and inwardly of said lower portion, said second peripheral wall providing means for receiving and supporting an edge portion of a sheet of ice or other ice mass which moves into contact with said upper portion so as to elevate said ice above its natural level an amount to cause said ice to fracture continuously adjacent said offshore structure, said second peripheral wall converging upwardly and inwardly at a greater slope than said first peripheral wall and the base diameter of said second peripheral wall being less than the top diameter of said first peripheral wall so that there exists a discontinuity between said first and second peripheral walls.

13. The offshore structure of claim 12 wherein said base portion forms a third peripheral wall which converges upwardly and inwardly of the underwater bottom and wherein the top diameter of said third peripheral wall forming said base portion is approximately equal to the base diameter of said first peripheral wall forming said lower portion.

14. The offshore structure of claim 13 further including:

a cylindrical throat portion rigidly supported on said upper portion for supporting a work platform above the surface of said body of water.

15. The offshore structure of claim 13 wherein said first peripheral wall converges upwardly and inwardly of said base portion at an angle of between approximately 15° and 25° from the horizontal and wherein said second peripheral wall converges upwardly and inwardly of said lower portion at an angle of between approximately 26° and 70° from the horizontal.

16. The offshore structure of claim 13 wherein said first peripheral wall converges upwardly and inwardly of said base portion at an angle of between approximately 19° and 23° from the horizontal and wherein said second peripheral wall converges upwardly and inwardly of said lower portion at an angle of between approximately 54° and 58° from the horizontal.

17. The offshore structure of claim 13 wherein said first peripheral wall converges upwardly and inwardly of said base portion at an angle of approximately 21° from the horizontal and wherein said second peripheral wall converges upwardly and inwardly of said lower portion at an angle of approximately 56° from the horizontal.

18. An offshore structure to be located in a body of water that contains ice masses, comprising:

a base portion;

means for securing said base portion to the bottom of a body of water;

a lower portion coaxially positionable on top of said base portion, said lower portion forming a first circumferential wall substantially in the shape of a first truncated cone so that the wall of said lower portion is inclined to the bottom of the body of water at an angle of between approximately 15° and 25° from the horizontal, said first circumferential wall providing a first ramp-like surface means for receiving ice masses moving relative to and in contact with said structure;

an upper portion coaxially positionable on top of said lower portion, said upper portion forming a second circumferential wall substantially in the shape of a second truncated cone so that the wall of said upper portion is inclined to the bottom of the body of water at an angle of between approximately 26° and 70° from the horizontal, said second circumferential wall providing a second ramp-like surface means for receiving ice masses moving relative to and in contact with said structure, the cross-sectional diameter of the wall of said upper portion being less than the cross-sectional diameter at the top of the wall of said lower portion so that there exists a step-like section between the wall of said upper portion and the wall of said lower portion; and a cylindrical throat portion supported on said upper portion.

19. The offshore structure of claim 18 wherein the wall of said upper portion is inclined to the bottom of the body of water at an angle of between approximately 54° and 58° from the horizontal and wherein the wall of said lower portion is inclined to the bottom of the body of water at an angle of between approximately 19° and 23° from the horizontal.

20. The offshore structure of claim 18 wherein the wall of said upper portion is inclined to the bottom of the body of water at an angle of approximately 56° from the horizontal and wherein the wall of said lower portion is inclined to the bottom of the body of water at an angle of approximately 21° from the horizontal.

21. A method of reducing the ice forces imposed on an offshore structure which contains ice masses, comprising:

constructing an offshore structure with a lower portion having a first circumferential wall substantially in the shape of a first truncated cone so that the wall of said lower portion is inclined at an angle to the horizontal, said first circumferential wall providing a ramp-like surface means for receiving ice masses moving relative to and in contact with said structure; and positioning an upper portion of said structure coaxially on top of said lower portion, said upper portion having a second circumferential wall substantially in the shape of a second truncated cone so that the wall of said upper portion is inclined at an angle to the horizontal, said second circumferential wall providing a ramp-like surface means for receiving ice masses moving relative to and in contact with said structure, the angle of inclination from the horizontal of the wall of said upper portion being greater than the angle of inclination from the horizontal of the wall of said lower portion and the cross-sectional diameter of the wall of said upper portion being less than the cross-sectional diameter at the top of the wall of said lower portion so that there exists a step-like section between the wall of said upper portion and the wall of said lower portion.

22. A method of reducing the ice forces imposed on an offshore structure which contains ice masses, comprising:

constructing an offshore structure with a base portion so that said base portion may be affixed to the bottom of a body of water;

positioning a lower portion of said structure coaxially on top of said base portion, said lower portion having a first circumferential wall substantially in the shape of a first truncated cone so that the wall of said lower portion is inclined at an angle to the horizontal, said first circumferential wall providing a ramp-like surface means for receiving ice masses moving relative to and in contact with said structure;

joining said lower portion to said base portion;

positioning an upper portion of said structure coaxially on top of said lower portion, said upper portion having a second circumferential wall substantially in the shape of a second truncated cone so that the wall of said upper portion is inclined at an angle to the horizontal, said second circumferential wall providing a ramp-like surface means for receiving ice masses moving relative to and in contact with said structure, the angle of inclination from the horizontal of the wall of said upper portion being greater than the angle of inclination from the horizontal of the wall of said lower portion and the cross-sectional diameter of the wall of said upper portion being less than the cross-sectional diameter at the top of the wall of said lower portion; and joining said upper portion to said lower portion so that there exists a step-like section between the wall of said upper portion and the wall of said lower portion.

23. The method of claim 22 wherein the angle of inclination of the wall of said lower portion is between about 15° and 25° from the horizontal and the angle of inclination of the wall of said upper portion is between about 26° and 70° from the horizontal.

24. The method of claim 22 wherein the angle of inclination of the wall of said lower portion is between about 19° and 23° from the horizontal and the angle of inclination of the wall of said upper portion is between about 54° and 58° from the horizontal.

25. The method of claim 22 wherein the angle of inclination of the wall of said lower portion is 21° from the horizontal and the angle of inclination of the wall of said upper portion is 56° from the horizontal.

26. The method of claim 22 further including:

positioning a cylindrical throat portion on top of said upper portion;

securing said throat portion to said upper portion; and extending a work platform above the surface of said body of water by joining said platform to said throat portion.

27. The method of claim 26 wherein the angle of inclination of the wall of said lower portion is between about 15° and and 25° from the horizontal and the angle of inclination of the wall of said upper portion is between about 26° and 70° from the horizontal.

28. The method of claim 26 wherein the angle of inclination of the wall of said lower portion is between about 19° and 23° from the horizontal and the angle of inclination of the wall of said upper portion is between about 54° and 58° from the horizontal.

29. The method of claim 26 wherein the angle of inclination of the wall of said lower portion is about 21° from the horizontal and the angle of inclination of the wall of said upper portion is about 56° from the horizontal.

* * * * *

UNITED STATES PATENT AND TRADEMARK OFFICE

CERTIFICATE OF CORRECTION

PATENT NO. : 4,239,418

DATED : December 16, 1980

INVENTOR(S) : J. C. Pearce

It is certified that error appears in the above–identified patent and that said Letters Patent are hereby corrected as shown below:

In the drawings, Sheet 1, Fig. 1, the designations of the angles involved (Fig. 1 now reads, $\alpha_1$ for the upper portion and $\alpha_2$ for the lower portion) should be switched so that $\alpha_1$ is used for the angle on the lower portion and $\alpha_2$ is used for the angle on the upper portion.

Signed and Sealed this

*Seventeenth* Day of *July 1984*

[SEAL]

*Attest:*

GERALD J. MOSSINGHOFF

*Attesting Officer*

*Commissioner of Patents and Trademarks*